US005622486A

United States Patent [19]

McDuffie et al.

[11] Patent Number: 5,622,486

[45] Date of Patent: Apr. 22, 1997

[54] RADIALLY-VALVE COMPRESSOR WITH ADJUSTABLE CLEARANCE

[75] Inventors: Thomas E. McDuffie, Henderson; Paul H. Bergthold, Longview, both of Tex.

[73] Assignee: J-W Operating Company, Dallas, Tex.

[21] Appl. No.: 684,065

[22] Filed: Jul. 19, 1996

[51] Int. Cl.[6] ..... F04B 39/10

[52] U.S. Cl. ..... 417/536; 417/568; 92/60.5

[58] Field of Search ..... 417/534, 535, 417/536, 521, 568; 92/60.5

[56] References Cited

U.S. PATENT DOCUMENTS

| | | | |
|---|---|---|---|
| 411,263 | 9/1889 | Sherman | 417/536 |
| 452,537 | 5/1891 | Winkler | 417/536 |
| 462,471 | 11/1891 | Cushing | 417/536 |
| 730,917 | 6/1903 | Jack | 417/536 |
| 746,344 | 12/1903 | Krohn | 417/536 |
| 1,579,782 | 4/1926 | Riesner | 92/60.5 |
| 1,586,278 | 5/1926 | Bardenheuer | 92/60.5 |
| 2,831,325 | 9/1958 | White . | |
| 3,125,963 | 3/1964 | Whitley et al. . | |
| 3,220,351 | 11/1965 | Kling . | |
| 3,354,790 | 11/1967 | Race | 92/60.5 |
| 3,620,653 | 11/1971 | Gaylord . | |
| 3,806,285 | 4/1974 | Sech . | |
| 3,877,841 | 4/1975 | Nakamura . | |
| 4,068,562 | 1/1978 | Frenkel | 92/60.5 |
| 4,568,249 | 2/1986 | Todd . | |
| 4,573,886 | 3/1986 | Maasberg et al. . | |
| 4,772,184 | 9/1988 | Laing et al. . | |
| 5,011,383 | 4/1991 | Bennitt . | |
| 5,015,158 | 5/1991 | Bennitt . | |
| 5,051,074 | 9/1991 | Cowan | 417/535 |
| 5,094,596 | 3/1992 | Erwin et al. . | |
| 5,118,265 | 6/1992 | Bearss . | |
| 5,141,413 | 8/1992 | Bennitt . | |
| 5,209,647 | 5/1993 | Bennitt . | |
| 5,246,355 | 9/1993 | Matzner et al. . | |
| 5,403,168 | 4/1995 | Evenson | 417/536 |

FOREIGN PATENT DOCUMENTS

| | | | |
|---|---|---|---|
| 866120 | 7/1949 | Germany | 92/60.5 |
| 0659782 | 8/1979 | U.S.S.R. | 92/60.5 |

*Primary Examiner*—Timothy Thorpe
*Assistant Examiner*—Peter G. Korytnyk
*Attorney, Agent, or Firm*—Drude Faulconer

[57] ABSTRACT

A radially-valved compressor wherein the fixed clearance of the compressor can be quickly and easily adjusted by adjusting the position of the suction and/or discharge valves in relation to their respective compression chambers. The valves are slidably positioned within the radial bores and are adjusted by means of threaded shafts which extend from the valves through the retainer caps which close the bores. When a valve is threadedly moved into its bore, the clearance within the compression chamber is decreased. When the valve is threadedly moved out of its bore, the fixed clearance is increased.

10 Claims, 2 Drawing Sheets

RADIALLY-VALVE COMPRESSOR WITH ADJUSTABLE CLEARANCE

TECHNICAL FIELD

The present invention relates to compressors and in one of its aspects relates to a gas compressor having radially-positioned valves, the position of which can be easily adjusted to vary the clearance within the compression chamber(s) of the compressor.

BACKGROUND ART

Of the different types of compressors, the reciprocating compressor is probably the most widely-used in transporting gas through pipelines and the like. In a reciprocating compressor, the gas is compressed by a piston which moves back and forth within a compression chamber formed within the "cylinder" of the compressor. These types of compressors usually have dual compression chambers within the cylinder whereupon a single piston becomes double-acting as it reciprocates in the cylinder. That is, the piston moves in a first direction to compressed gas in one compression chamber and expel it through an outlet or discharge valve while drawing gas into the other compression chamber through an inlet or suction valve. The operation is reversed when the piston moves in the opposite direction.

The overall efficiency of a reciprocating compressor is related to the "fixed clearance" of the compressor; "fixed clearance" being that volume remaining in the compression chamber when the reciprocating piston is at the end of its compression stroke. As will be recognized by those skilled in this art, for a compressor to reach its maximum efficiency for a particular set of operating conditions (e.g. horsepower available, composition of gas suction and discharge temperatures and pressures, etc.), it is necessary to adjust its fixed clearance to the smallest volume as is practical for such conditions. Since these conditions may vary from time to time during an on-going operation or from operation to operation, it is highly beneficial to be able to easily and quickly adjust the clearance of a compressor to optimize its efficiency for the then-existing conditions with only a minimum of downtime and expense.

There are at least two general types of reciprocating compressors; one where the suction and discharge valves are "in-line" within the cylinder and the other where the suction and discharge valves are radially mounted within the cylinder heads or within the cylinder wall. In one such in-line valve compressor, the suction valves, which may be adjusted to change the clearance, are positioned concentrically within the cylinder while the discharge valve is carried by the reciprocating piston, itself; see U.S. Pat. Nos. 5,011,383; 5,015,158; 5,141,413; and 5,209,647. In another known, in-line valve compressor, the suction valve is carried by the piston and the discharge valve is adjustably positioned within the cylinder whereby the clearance can be changed; see co-pending and commonly-assigned U.S. application Ser. No. 08/507,765, filed Jul. 26, 1995.

It has been found that by merely placing the valves in-line with the cylinder, it is possible to substantially reduce the fixed clearance for the compressor. Further, by making the position of one of the valves adjustable, this type of commercially-available compressor becomes very efficient in a large number of operations. However, since the mounting of a valve in a travelling piston limits how small the cylinder can be in in-line compressors of this type, there are still many every day operations in which in-line compressors can not be used economically. Accordingly, there are still a large number of gas-compressing operations where the more conventional, radial-valved compressors are much more economical to operate.

In known prior art, the "fixed clearance" of radial-valved compressors is adjusted by actually removing the suction and/or discharge valves from their respective radial bores and then adding or removing spacers before reassembling the valve(s) into its bore(s). The spacers adjust the operating position of a valve within its radial bore thereby either increasing or decreasing the "fixed clearance" of that particular compression chamber, as the case may be. As will be recognized, this technique is time consuming and can result in expensive downtime of the compressor. Further, since the spacers are of defined thicknesses, the amount of clearance can only be adjusted in set increments and accordingly, it is unlikely that the valve can be adjusted to an exact position which will produce the optimum efficiency for the compressor at the then-existing operating conditions.

SUMMARY OF THE INVENTION

The present invention provides a radially-valved compressor wherein the fixed clearance of the compressor can be adjusted to improve the efficiency of the compressor under differing sets of actual field conditions. This is accomplished by slidably mounting the suction and/or discharge valves in their respective radial bores so that their positions can be adjusted to change the fixed clearance within the respective compression chambers. By being able to make these adjustments without disassembling the compressor, the downtime required is minimal.

More specifically, the present invention provides a radially-valved compressor which is comprised of a cylinder which has a first head mounted on one end and a second head mount on the other end. The first head has a center bore through which a piston rod is slidably positioned. A piston is mounted on one end of the piston rod and defines two compression chambers within the cylinder; a first chamber between one side of the piston and the first head and a second chamber between the other side of the piston and the second head.

The internal configuration of both heads are similar in that each has two diametrically-opposed, radial bores (i.e. one inlet bore and one outlet bore ) with the respective longitudinal axes of each bores being perpendicular to the longitudinal axis of cylinder. A suction valve is slidably positioned within each of the inlet bores and a discharge valve is slidably positioned within each of the outlet bores. Each of the valves is comprised of a valve body and a means of adjusting the position of the valve body within its bore. The adjusting means is comprised of a threaded shaft which has one end connected to the valve body and the other end threadingly extending through a threaded, central opening in a retainer cap which, in turn, are bolted or otherwise secured onto the heads to sealing close the radial bores. A lock nut or the like is threaded onto the outer end of the shaft to secure the valves in desired position within the bore.

It can be seen that the "fixed clearance" of the compression chambers of the present compressor can be easily and quickly adjusted without any disassembly of the compressor since the valves do not have to be removed from their respective bores. The position of the valves can be adjusted by merely loosening the lock nut on the valve shafts and then rotating the threaded shafts to move the valves with respect to retainer caps to thereby move the valves into or out of their bores, as the case may be. When a valve is threadedly moved into its bore, the clearance within the compression chamber is decreased. When the valve is threadedly moved out of its bore, the fixed clearance is increased.

BRIEF DESCRIPTION OF THE DRAWINGS

The actual construction, operation, and apparent advantages of the present invention will be better understood by referring to the drawings which are not necessarily to scale and in which like numerals refer to like parts and in which.

BEST KNOWN MODE FOR CARRYING OUT INVENTION

Figure 1:
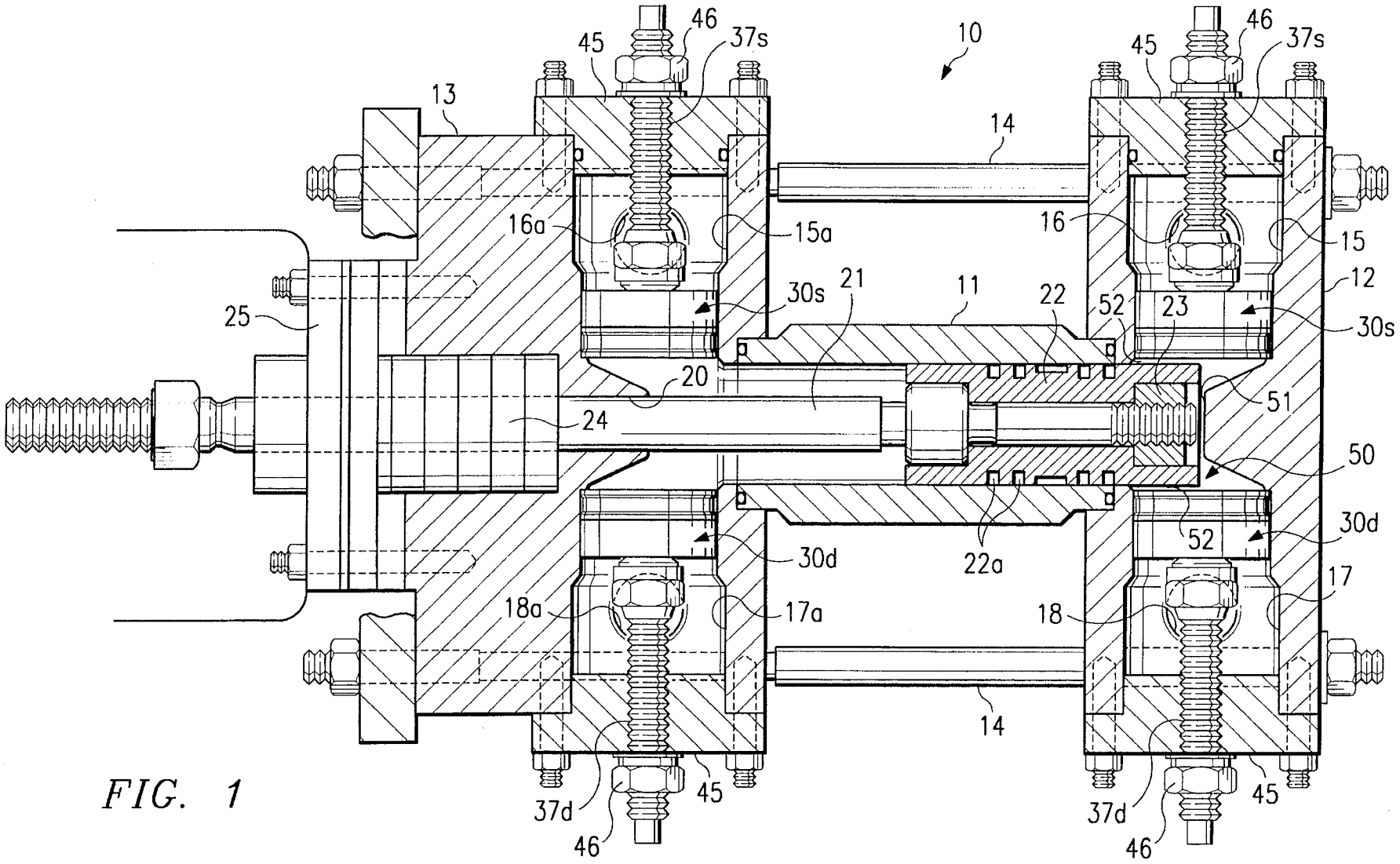
FIG. 1 is a cross-sectional view of a radially-valved compressor in accordance with the present invention.

In accordance with the present invention, FIG. 1 discloses a radially-valved compressor 10 in which the "fixed clearance" within the compression chamber(s) is easily and quickly adjustable. The term "radially-valved compressor" as used herein refers to a compressor wherein its suction and discharged valves are mount in bores whose centerlines or longitudinal axes are perpendicular to the centerline or longitudinal axis of the compressor cylinder.

Compressor 10 is comprised of a cylinder 11 which is closed at each end with heads 12, 13, which, in turn, are held in place on cylinder 11 by tie-rods 14 (only two shown) or the like, as will be understood in the art. Head 13 at the crank end has a longitudinal bore 20 through which piston rod 21 is slidably positioned. Piston 22 has annular grooves 22*a* for receiving sealing means (e.g. O-rings or the like, not shown) and is secured onto the outer end of rod 21 by nut 23 or the like. Packing 24 is positioned between rod 21 and head 13 to prevent flow therebetween, as will be understood in the art. The packing is held in place by cover plate 25.

The internal configuration of both heads 12 and 13 are basically similar in that each has two diametrically-opposed, radial bores (i.e. bores 15, 15*a* having inlet ports 16, 16*a*, and bores 17, 17*a* having outlet ports 18, 18*a*, respectively). As seen in FIG. 1, the respective longitudinal axes of each of these bores will lie perpendicular to the longitudinal axis of cylinder 11 ( i.e. the bores are radial with respect to the cylinder) when the heads are in position on the cylinder.

Figure 2:
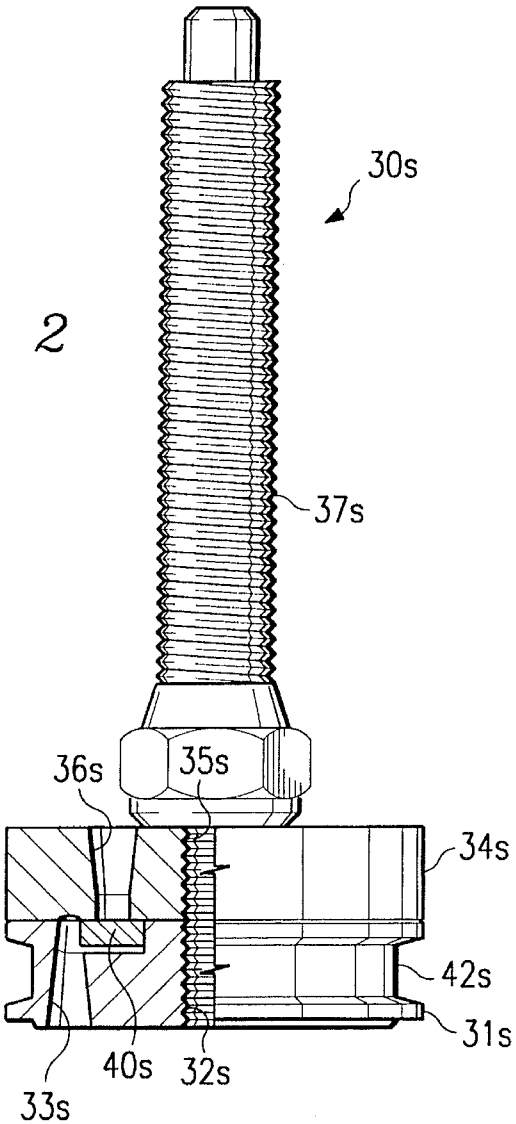
FIG. 2 is an elevational view, partly in section, of a typical suction valve which is used in the compressor of FIG. 1.

Suction valves 30*s* are respectively positioned within bores 15, 15*a* and discharge valves 30*d* are respectively positioned within bores 16, 16*a*. Suction valves 30*s* are basically identical to each other. Referring now to FIG. 2, valve 30*s* is comprised of a valve body which, in turn, is comprised of a cylindrical retainer 31*s* and a valve seat 34*s*. Retainer 31*s* has a threaded bore 32*s* and at least one longitudinal passage 33*s* therethrough. Valve seat 34*s* has a threaded bore 35*s* which aligns with bore 32*s* and at least one longitudinal passage 36*s* which fluidly communicates with passage 33*s* when retainer 31*s* is concentrically mounted on valve seat 34*s*. It should be understood that more than one parallel, fluidly-aligned passages 33*s*, 36*s* (only one shown) can be radially-spaced through valve 30*s* to provide for greater flow through the valve, if such is needed.

Shaft 37*s* is connected at one end to the valve body in that it is threaded through aligned bores 32*s* and 35*s* to secure retainer 31*s* and valve seat 34*s* together. The other end of shaft 37*s* is also threaded along its length for a purpose described later. A valve element, i.e. ring 40*s*, moves out of or into sealing contact with valve seat 34*s* to open or close passage 36*s* as will be understood. Valve retainer 31*s* has an annular groove 42 thereon for receiving sealing means (not shown) to prevent flow pass the valve when it is in position within its respective bore.

Figure 3:
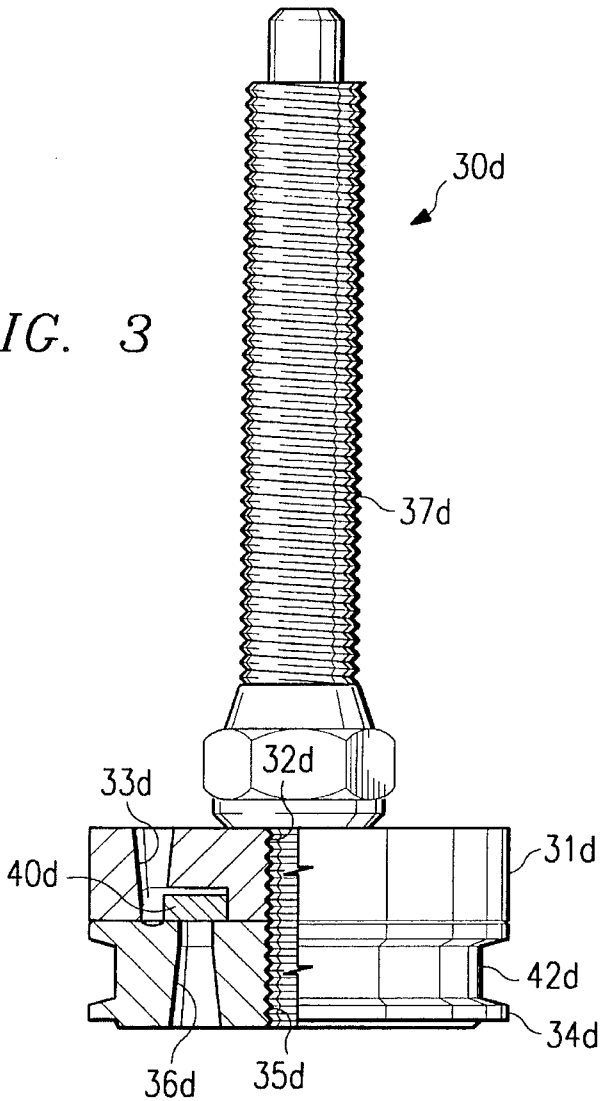
FIG. 3 is an elevational view, partly in section, of a typical discharge valve which is used in the compressor of FIG. 1.

Discharge valves 30 are basically identical to each other and are similar to suction valves 30*s*. Referring now to FIG. 3, discharge valve 30*d* is comprised of a valve body which, in turn, is comprised of cylindrical retainer 31*d* having a threaded bore 32*d* and at least one longitudinal passage 33*d* therethrough. Valve seat 34*d* has a threaded bore 35*d* which aligns with bore 32*d* and at least one longitudinal passage 36*d* which fluidly communicates with passage 33*d* when retainer 31*d* is concentrically mounted on valve seat 34*d*. Again, it should be understood that more than one parallel, fluidly-aligned passages 33*d*, 36*d* (only one shown) can be radially-spaced through valve 30*d* to provide greater flow through the valve, if such is needed.

Shaft 37*d* has one end threaded through aligned bores 32*d* and 35*d* to secure retainer 31*d* to valve seat 34*d*. The other end of shaft 37*d* is also threaded along its length for a purpose described later. A valve element, i.e. ring 40*d*, moves out of or into sealing contact with valve seat 34*d* to open or close passage 33*d* to flow as the case may be. Valve seat 34*d* has an annular groove 42*d* thereon for receiving sealing means (not shown) to prevent flow pass the valve when it is in position within its respective bore. The actual construction of the valve bodies of the suction and discharge valves is not considered critical to the present invention and are similar to valves of this type which are commercially-available; e.g. compressor valves distributed by Hoerbiger Corporation of America, Inc., Ft. Lauderdale Fla.

Each valve 30*s*, 30*d* is positioned within its respective bore with their respective shafts 37*s*, 37*d* being threaded through a central opening in respective retainer caps 45 which, in turn, are bolted or otherwise secured onto the heads to sealing close the respective pores. A lock nut 46 or the like is threaded onto the outer end of shaft 37*s*, 37*d* to secure the valves 30*s*, 30*d* in position once each has been adjusted within its respective bore as will be explained below.

Referring again to FIG. 1, the present compressor 10 operates as follows. Gas flows from a source (not shown) to inlet ports 16, 16*a* in heads 12, 13, respectively. As shown in FIG. 1, rod 21 has moved all the way to the right where piston 22 has completed its compression stroke in a first direction. Note that at this point, the "fixed clearance 50" in the first compression chamber (i.e. that portion of cylinder 11 which lies to the right of piston 22) is at its smallest volume. That is, fixed clearance 50 consists of (a) the volume between the end of piston 22 and the end 51 of head 12 and (b) the volume 52 existing between the circumference of piston 22 and the bottoms of suction valve 30*s* and discharge valve 30*d* in head 12.

As will be understood by those skilled in this art, the fixed clearance of a compressor directly affects the actual capacity and volumeric efficiency of the compressor. That is, as the clearance increases, both the capacity and efficiency of the compressor decreases. Theoretically, it would be desirable for a particular compressor to have the absolute smallest clearance possible. However, this is not practical since in many instances, there will be not sufficient horsepower available to operate a compressor having too small of clearance. Accordingly, for a particular commercial-available, radial-valved compressor to economically operated for a wide range of applications in the field, it is necessary to be able to adjust the clearance of the compressor to the smallest volume which is practical under the actual operating conditions involved at the time.

It can be seen that the "fixed clearance" of the first compression chamber of present compressor 10 can be easily and quickly adjusted without any disassembly of the compressor since the valves do not have to be removed from their respective bores. This adjustment can be made by merely loosening lock nut 46 on either or both of the shafts 37*s*, 37*d* of valves 30*s* and/or 30*d* and then rotating the threaded shafts to move the valves with respect to retainer caps 45 to thereby move the valves into or out of their bores, as the case may be. When a valve 30 is threadedly moved into its bore, the volume 52 between the valve and the piston 22 is decreased, hence the fixed clearance 50 is decreased. When the valve is threadedly moved out of its bore, fixed clearance 50 is increased.

Once the valves have been positioned within their respective bores to provide the desired clearance, lock nuts 46 are tightened to secure the valves in position. The volumes of the compression chambers, the volumes of the respective bores, and the distance a valve will move in response to the rotation of the threaded shafts will all be accurately known at the time of manufacture. Accordingly, in accordance with the present invention, a detailed set of operating instructions can be provided for a particular compressor which will allow an operator in the field to rotate each shaft a precise number of turns or parts thereof to arrive at the exact desired final clearance for each of the compression chambers of the compressor.

As piston rod 20 moves to the position shown in FIG. 1, gas in the first compression chamber was compressed to a prescribed pressure at which discharge valve 30*d* in head 12 opens to allow the compressed gas to be discharged through outlet port 18. At the same time, piston 22 causes suction valve 30*s* in head 13 to open to thereby allow gas to flow through inlet port 16*a* into the second compression chamber (i.e. chamber in cylinder 11 which lies to the left of piston 22). This operation of the valves is reversed when the piston 22 reciprocates within cylinder 11 allowing gas to be compressed and discharged from the second compression chamber.

What is claimed is:

1. A gas compressor comprising:

a cylinder;

a first head having a center bore therethrough mounted on one end of said cylinder and a second head mounted on the other end of said cylinder; each of said heads having a radial inlet bore and a radial outlet bore whose respective longitudinal axes lie perpendicular to the longitudinal axis of said cylinder;

a piston rod slidably mounted through said center bore in said first head;

a piston mounted on one end of said piston rod and positioned for reciprocating movement within said cylinder, said piston defining a first compression chamber within said cylinder between one side of said piston and said first head and one which is in fluid communication with said radial inlet and outlet bores in said first head and a second compression chamber within said cylinder between the other side of said piston and said second head and one which is in fluid communication with said radial inlet and outlet bores within said second head; and a valve slidably mounted in each of said radial bores;

means for adjusting the position of at least one of said valves within its respective bore to thereby adjust the fixed clearance within its respective compression chamber.

2. The compressor of claim 1 wherein said means for adjusting the position of said valve within said bore comprises:

a cap for closing said bore, said cap having a opening therethrough;

a shaft connected to said valve and extending through said opening in said cap; and means for moving said shaft relative to said cap to thereby move said valve into and out of said bore.

3. The compressor of claim 2 wherein both said opening through said cap and said shaft have cooperating threads.

4. The compressor of claim 3 including:

a lock nut threaded into said shaft to lock said valve in position within said bore.

5. The compressor of claim 1 wherein each of said valves includes said means for adjusting the position of said valve within its bore to thereby adjust the clearance of each of said compression chambers.

6. A gas compressor comprising:

a cylinder;

a first head having a center bore therethrough mounted on one end of said cylinder and a second head mounted on the other end of said cylinder; each of said heads having a radial inlet bore and a radial outlet bore whose respective longitudinal axes lie perpendicular to the longitudinal axis of said cylinder;

a piston rod slidably mounted through said center bore in said first head;

a piston mounted or one end of said piston rod and positioned for reciprocating movement within said cylinder, said piston defining a first compression chamber within said cylinder between one side of said piston and said first head and one which is in fluid communication with said radial inlet and outlet bores in said first heed and a second compression chamber within said cylinder between the other side of said piston and said second head and one which is in fluid communication with said radial inlet and outlet bores within said second head; and a suction valve slidably mounted in each of said radial inlet bores;

a discharge valve slidably mounted in each of said radial inlet bores;

means for adjusting the position of at least one of said valves in each of said heads within its respective bore to thereby adjust a fixed clearance within its respective compression chamber.

7. The compressor of claim 6 wherein each of said suction and discharge valves includes said means for adjusting the position of said valve within its bore to thereby adjust the clearance of each of said compression chambers.

8. The compressor of claim 7 wherein said means for adjusting the position of each of said valves within each of said heads within their respective bores comprises:

a cap for closing said bore, said cap having a opening therethrough;

a shaft connected to said valve and extending through said opening in said cap; and means for moving said shaft relative to said cap to thereby move said valve into and out of said bore.

9. The compressor of claim 8 wherein both said opening through said cap and said shaft have cooperating threads.

10. The compressor of claim 9 including:

a lock nut threaded onto said shaft to lock said valve in position within said bore.

* * * * *